US011142974B2

(12) United States Patent
Simon et al.

(10) Patent No.: US 11,142,974 B2
(45) Date of Patent: Oct. 12, 2021

(54) ACTUATION DEVICES FOR WELL TOOLS

(71) Applicant: Halliburton Energy Services, Inc., Houston, TX (US)

(72) Inventors: Michael Charles Simon, Little Elm, TX (US); Homero Dejesus Maldonado, Dallas, TX (US); Franklin Charles Rodriguez, Addison, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 173 days.

(21) Appl. No.: 15/779,023

(22) PCT Filed: Dec. 29, 2015

(86) PCT No.: PCT/US2015/067874
§ 371 (c)(1),
(2) Date: May 24, 2018

(87) PCT Pub. No.: WO2017/116418
PCT Pub. Date: Jul. 6, 2017

(65) Prior Publication Data

US 2018/0355688 A1 Dec. 13, 2018

(51) Int. Cl.
*E21B 31/20* (2006.01)
*E21B 23/01* (2006.01)
(Continued)

(52) U.S. Cl.
CPC ..... *E21B 23/01* (2013.01); *E21B 17/042* (2013.01); *E21B 23/02* (2013.01); *E21B 41/00* (2013.01)

(58) Field of Classification Search
CPC combination set(s) only.
See application file for complete search history.

(56) References Cited

U.S. PATENT DOCUMENTS 2,399,766 A * 5/1946 Steward ..... E21B 23/06 166/66.4
3,029,874 A * 4/1962 Turman ..... E21B 7/061 166/212

(Continued)

FOREIGN PATENT DOCUMENTS

WO WO-2015094285 A1 6/2015
WO WO-2015122916 A1 8/2015

OTHER PUBLICATIONS

International Search Report prepared by Authorized Office Joong Sub Han, of the Korean Intellectual Property Office, as ISA, dated Aug. 24, 2016; issued in corresponding International Patent Application No. PCT/US2015/067874.

(Continued)

*Primary Examiner* — Cathleen R Hutchins
*Assistant Examiner* — Ronald R Runyan
(74) *Attorney, Agent, or Firm* — Locke Lord LLP

(57) ABSTRACT

An actuation device for well operations can include a tubular body including a plurality of key slots, a threaded shaft disposed within the tubular body that rotates relative to the tubular body and is fixed axially relative to the tubular body, an actuator disposed within the tubular member that moves axially relative to the tubular body, wherein the actuator includes a ramp portion and a threaded neck portion that engages with the threaded shaft such that when the threaded shaft rotates, the actuator moves axially relative to the tubular body, and a plurality of keys, each disposed in one of the plurality of key slots and in operative communication with the ramp portion such that as the actuator moves axially relative to the tubular body, each key is urged radially outwardly from the tubular body.

18 Claims, 9 Drawing Sheets

(51) Int. Cl.

| | |
|---|---|
| ***E21B 41/00*** | (2006.01) |
| ***E21B 17/042*** | (2006.01) |
| ***E21B 23/02*** | (2006.01) |

(56) References Cited

U.S. PATENT DOCUMENTS

| | | | | |
|---|---|---|---|---|
| 3,830,295 | A * | 8/1974 | Crowe | E21B 23/06 166/125 |
| 4,153,109 | A * | 5/1979 | Szescila | E21B 7/061 166/117.6 |
| 4,406,324 | A * | 9/1983 | Baugh | E21B 23/02 166/125 |
| 4,573,537 | A * | 3/1986 | Hirasuna | E21B 33/1292 166/134 |
| 6,279,669 | B1 | 8/2001 | Swietlik et al. | |
| 7,909,120 | B2 * | 3/2011 | Slack | E21B 23/006 175/423 |
| 8,453,744 | B2 | 6/2013 | Buss et al. | |
| 8,469,109 | B2 | 6/2013 | Wang et al. | |
| 8,657,038 | B2 | 2/2014 | Radford et al. | |
| 8,973,679 | B2 | 3/2015 | Dewey et al. | |
| 2002/0070052 | A1 | 6/2002 | Armell et al. | |
| 2006/0131076 | A1 | 6/2006 | Zupanick | |
| 2013/0062075 | A1 | 3/2013 | Brennan, III | |
| 2014/0260456 | A1 * | 9/2014 | Dewalch | E05B 47/0009 70/283.1 |
| 2015/0218904 | A1 | 8/2015 | Chauffe et al. | |

OTHER PUBLICATIONS

Bean Can Fishing Tool, Brochure, Oilenco, oilenco.com, accessed: Aug. 2015. http://www.oilenco.com/wp-content/uploads/2015/01/Bean-Can-Fishing-Tool.pdf Discloses a tool designed for recovery of downhole safety valve with lock-open expandable sleeves.

Peak launches FlexDrift adjustable downhole tool, Offshore, offshoremag.com, Jul. 30, 2015. http://www.offshore-mag.com/articles/2015/07/peak-launches-flexidrift-adjustable-downhole-tool.html Discloses the FlexiDrift adjustable tool featuring a mandrel with two sets of extendable rails that can be manually adjusted to the desired radius of the well tubing.

Weatherford, Sean Yakeley, "Liner system designed to provide effective isolation in high-risk, high-cost HPHT wells," Drilling Contractor, drillingcontractor.org, Jul. 8, 2015. http://www.drillingcontractor.org/liner-system-designed-to-provide-effectiveisolation-in-high-risk-high-cost-hpht-wells-35970 Discloses a liner system with swage technology featuring seals for isolation, protection and back off protection, and zonal isolation application.

* cited by examiner

ACTUATION DEVICES FOR WELL TOOLS

CROSS REFERENCE TO RELATED APPLICATIONS

This application is a National Phase Application under 35 U.S.C. § 371 of PCT International Application No. PCT/US2015/067874, filed Dec. 29, 2015, the entire contents of which are hereby incorporated by reference herein in their entirety.

BACKGROUND

1. Field

The present disclosure relates to wells, more specifically to actuation devices for well tools.

2. Description of Related Art

Certain devices for use in wells are actuated hydraulically. Such hydraulically actuated devices (e.g., hydraulic setting tools) do not allow the user to control setting diameter or force. The hydraulic tools are either fully deployed or fully retracted or transitioning from one position to the other.

Such conventional methods and systems have generally been considered satisfactory for their intended purpose. However, there is still a need in the art for improved actuation devices for well tools. The present disclosure provides a solution for this need.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1A:
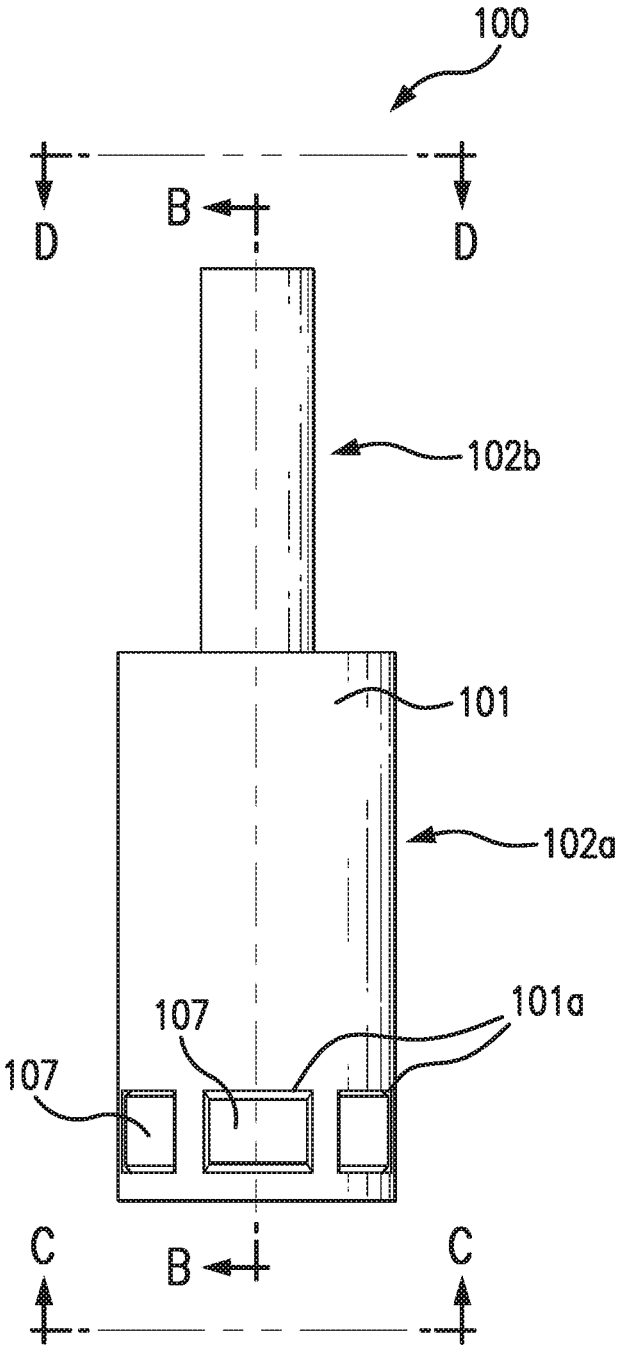
FIG. 1A is a side elevational view of an embodiment of an actuation device in accordance with this disclosure, shown having an actuator in a retracted position.

Reference will now be made to the drawings wherein like reference numerals identify similar structural features or aspects of the subject disclosure. For purposes of explanation and illustration, and not limitation, an illustrative view of an embodiment of an actuation device in accordance with the disclosure is shown in FIG. 1A and is designated generally by reference character 100. Other embodiments and/or aspects of this disclosure are shown in FIGS. 1B-4. The systems and methods described herein can be used to control actuation and deployment of one or more mechanical features of a well tool (e.g., an anchor).

Figure 1B:
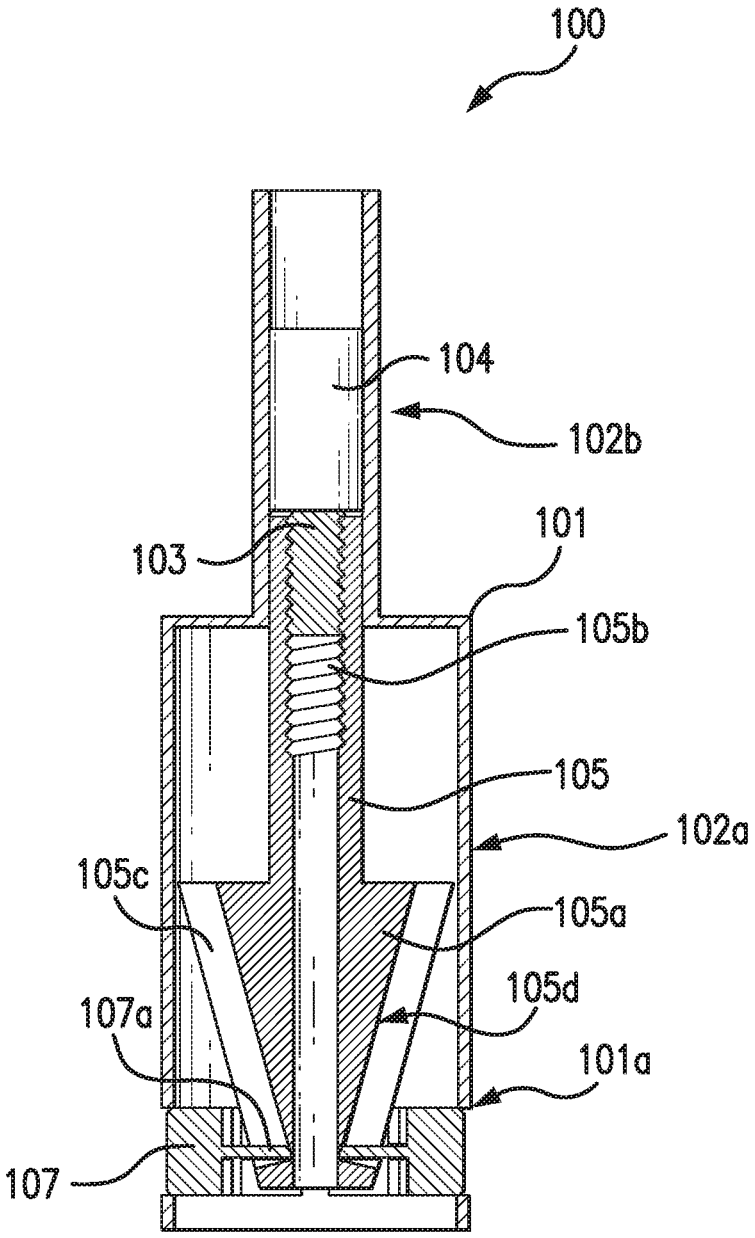
FIG. 1B is a cross-sectional elevation view of the actuation device of FIG. 1A, shown having an actuator in a retracted position.
Figure 1C:
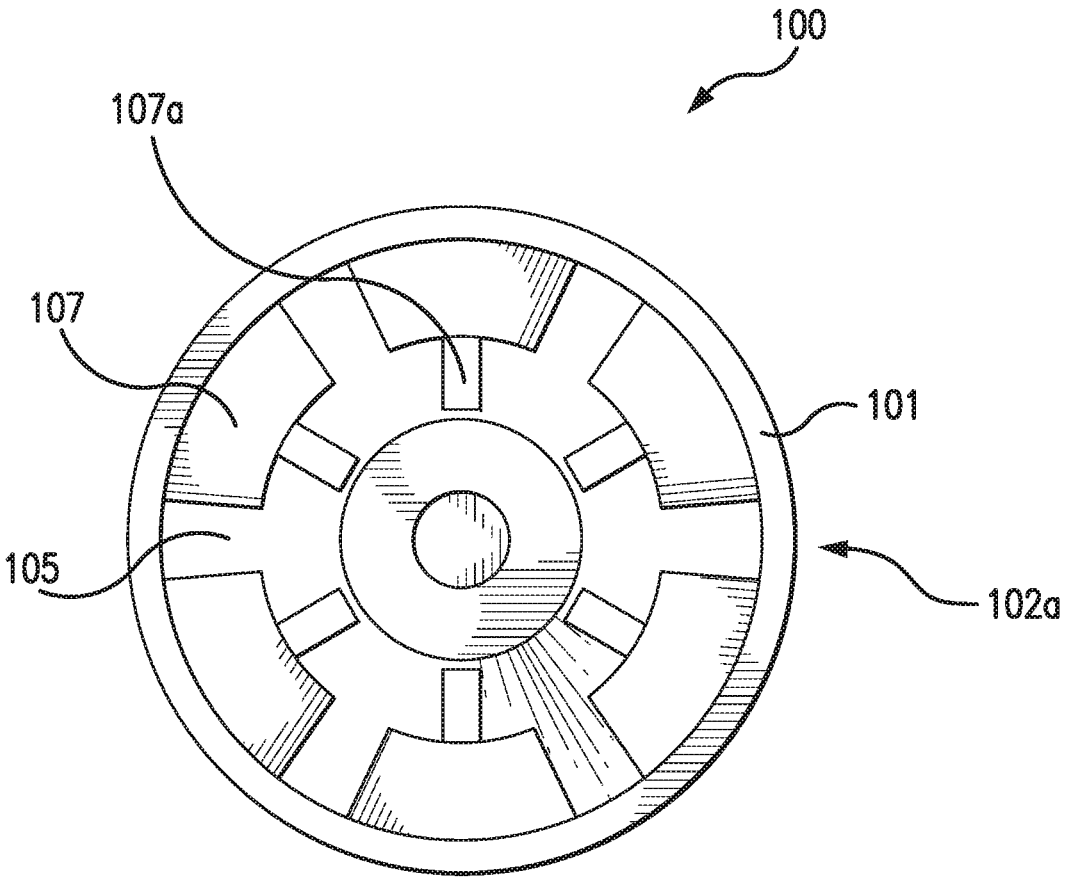
FIG. 1C is an upward plan view of the actuation device of FIG. 1A, shown having an actuator in a retracted position.
Figure 1D:
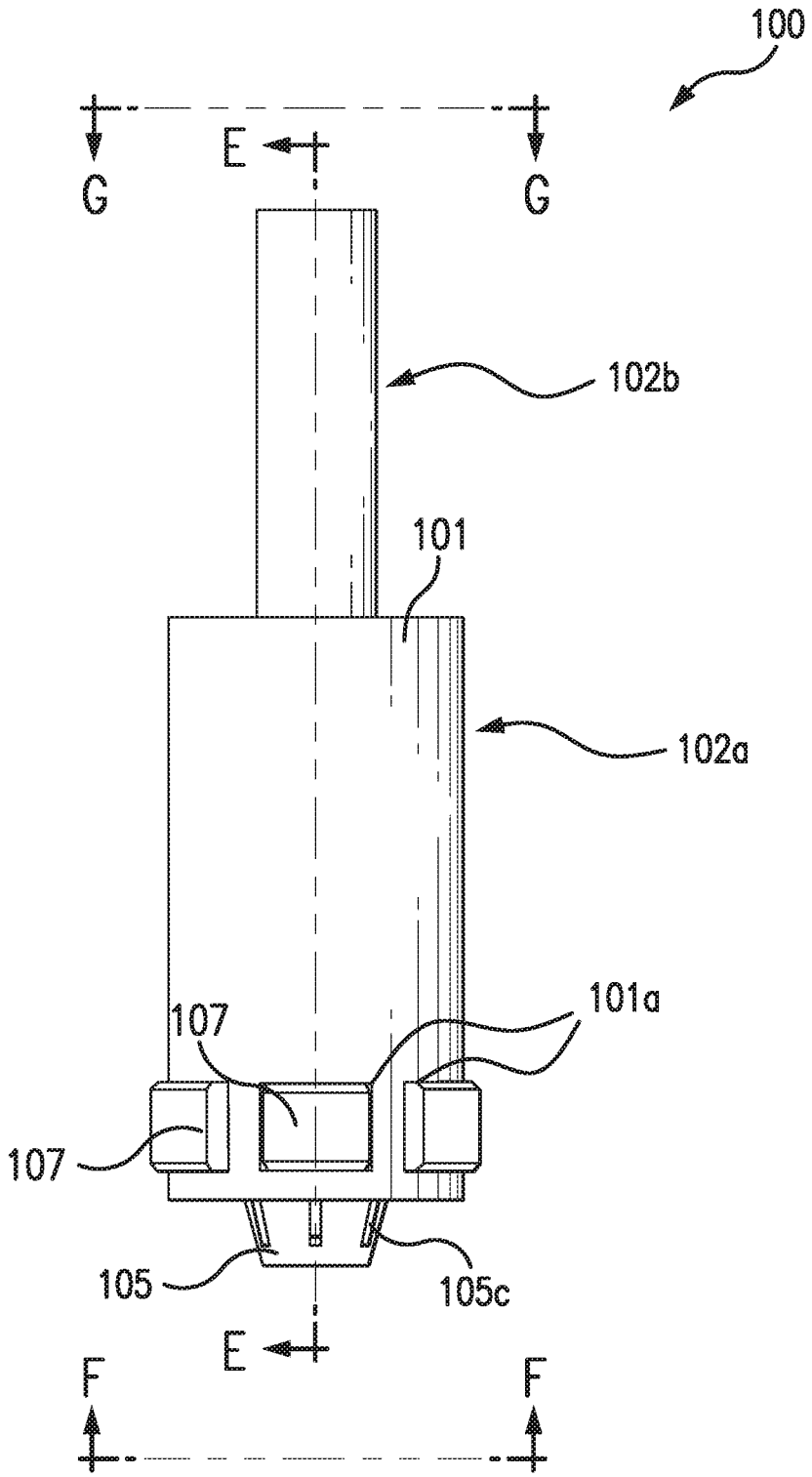
FIG. 1D is a side elevational view of the actuation device of FIG. 1A, shown having the actuator in the deployed position.

Referring to FIGS. 1A and 1D, an actuation device 100 for one or more well operations is shown in a retracted state (e.g., FIG. 1A) and a deployed or at least partially deployed state (e.g., FIG. 1D). The actuation device 100 can include a tubular housing or body 101 having a plurality of key slots 101*a* that can receive a plurality of keys 107. As shown, the tubular body 101 can include a larger diameter portion 102*a* below a neck portion 102*b*.

Figure 1E:
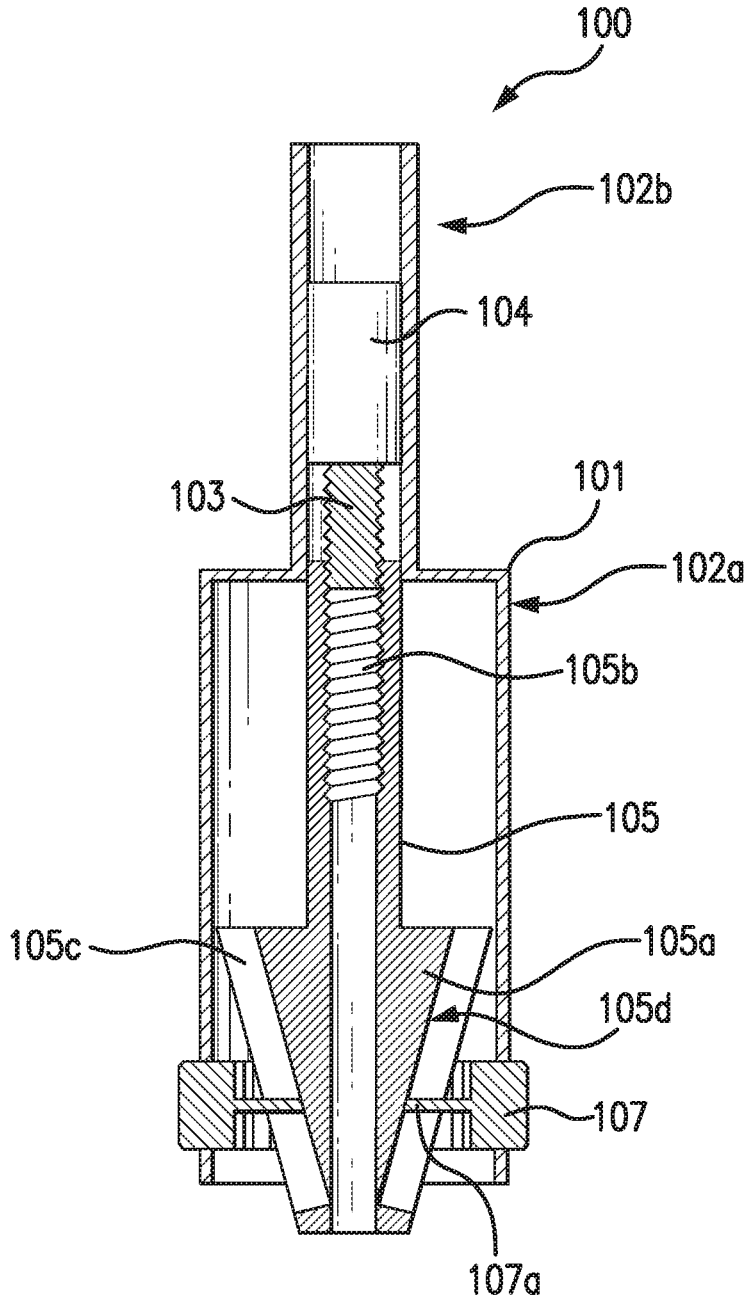
FIG. 1E is a cross-sectional elevation view of the actuation device of FIG. 1A, shown having the actuator in a deployed position.

Referring additionally to FIGS. 1B and 1E, a cross-sectional view of the actuation device 100 is shown in a retracted state (e.g., FIG. 1B) and a deployed or at least partially deployed state (e.g., FIG. 1E). As shown, the actuation device 100 includes a threaded shaft 103 contained within the neck portion 102*b* of the tubular body 101 and which can be rotatable relative to the neck portion 102*b* of the tubular body 101.

The threaded shaft 103 can be operatively associated with an electric motor 104 that rotates the threaded shaft 103, which can be powered using any suitable electrical source (e.g., using a wire from the surface, using a battery). However, any suitable actuation scheme (e.g., hydraulic, mechanical, electromechanical) to rotate the threaded shaft 103 is contemplated herein.

The motor 104 can be fixed in any suitable manner to the inside of the neck portion 102*b*, and therefore is prevented from moving axially in response to axial forces. In this regard, the threaded shaft 103 is also fixed axially relative to the tubular body 101, but can rotate relative to the body 101. In embodiments without electrical actuation, the electric motor 104 can be replaced with a suitable anchored bearing to allow the threaded shaft 103 to be anchored axially within the neck portion 102*b* of the tubular body 101, but rotate relative to the body 101 via any suitable actuation (e.g., a suitable hydraulic circuit, a suitable mechanical linkage).

An actuator 105 is disposed within the tubular member 101 and can move axially relative to the tubular body 101. The actuator 105 includes a ramp portion 105*a* and a threaded neck portion 105*b* that engages with the threaded shaft 103 such that when the threaded shaft 103 rotates, the actuator 105 moves axially. In this respect, the threaded neck portion 105*b* and the threaded shaft 103 may embody a form of a worm gear. The worm gear can allow continuous and/or controllable movement thereof between any suitable number of positions, whether discrete or otherwise. This allows for movement of the actuator 105 to any suitable position (e.g., partially deployed positions) as desired. Also, when the worm gear is not moving, it can be locked such that force can be applied to an associated tubing string without affecting a position of keys 107, described in more detail below.

As shown, the threaded neck portion 105*b* of the actuator 105 can include internal threads disposed within the threaded neck 105*b*. Also as shown, the threaded shaft 103 can include threads on an outer diameter thereof. However, it is contemplated that the reverse is possible as long as the threaded shaft 103 and threaded neck portion 105*b* engage with each other in a worm gear fashion such that the threaded neck portion 105*b* moves axially relative to the threaded shaft 103 in response to rotation of the threaded shaft 103.

The threads on each of threaded shaft 103 and threaded neck portion 105*b* can have a pitch, thickness, or other characteristic allowing a specific amount of axial movement per unit of rotation. For example, if fine movements are desired, finer threads and/or shallower thread pitch can be used. The finer the pitch of the threads, the more precision of axial control exists.

Figure 1F:
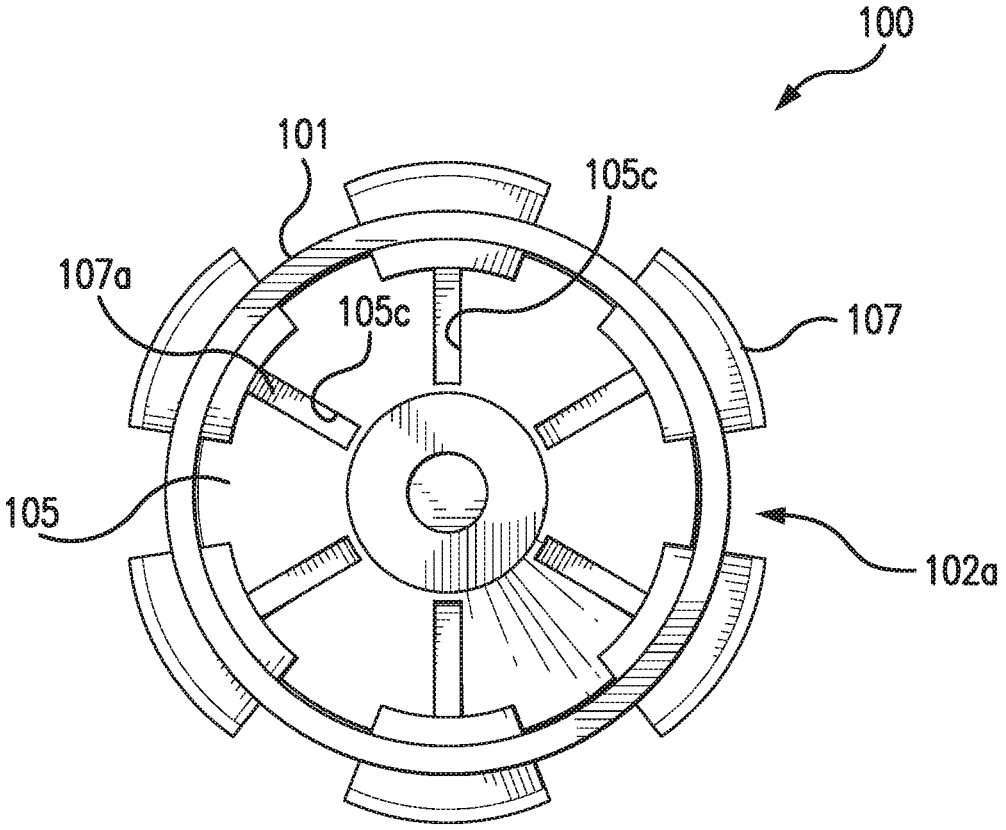
FIG. 1F is an upward plan view of the actuation device of FIG. 1A, shown having an actuator in a deployed position.

Referring additionally to FIGS. 1C and 1F, the plurality of keys 107 mentioned earlier is shown within the tubular body 101. Each key 107 is disposed in one of the plurality of key slots 101*a* and is in operative communication or engagement with the ramp portion 105*a* such that, as the actuator 105 moves axially toward the keys 107, each key 107 is pushed radially outwardly from a retracted position (e.g., as shown in FIGS. 1A-1C) to a deployed position (e.g., as shown in FIGS. 1D-1F) in which the keys 107 protrude radially outward of the tubular body 101. The key slots 101*a* can act as a guide for the keys 107 as the keys 107 are extended and/or retracted.

Figure 4:
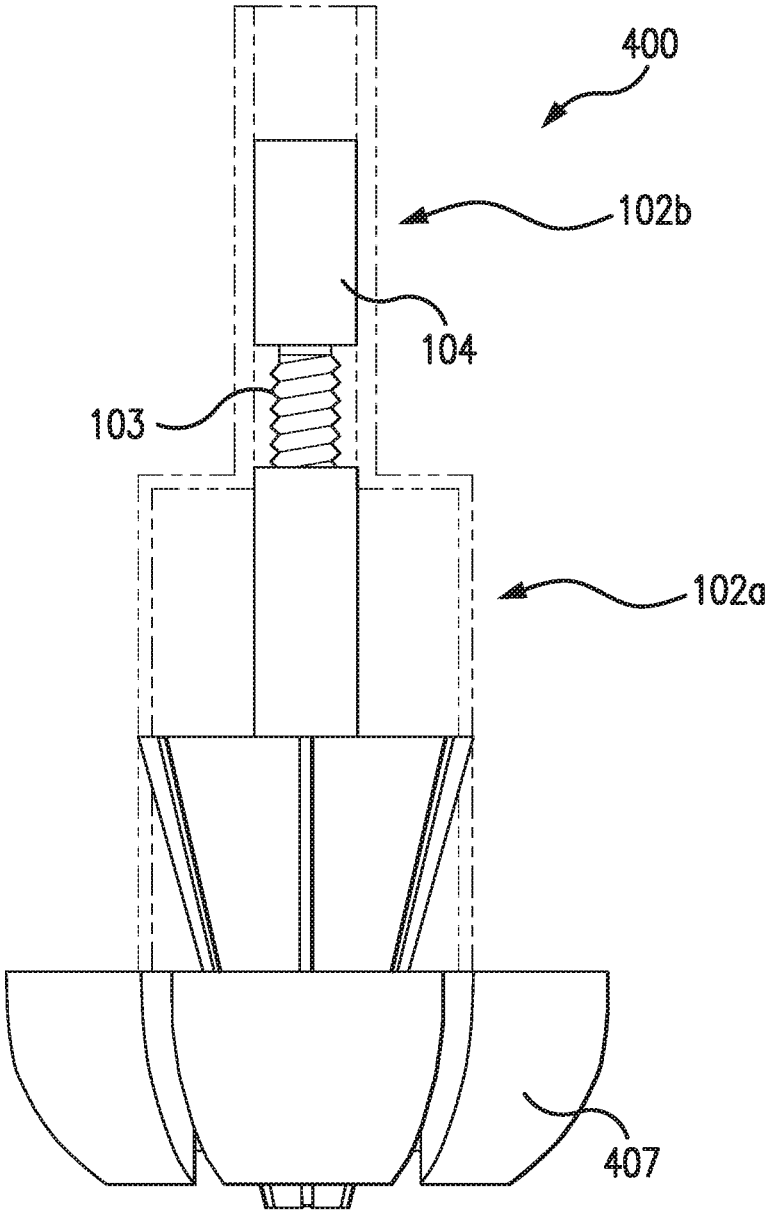
FIG. 4 is a schematic elevation of an embodiment of an actuation device in accordance with this disclosure, shown having an adjustable bullnose configuration with a possible embodiment of curved keys.

The keys 107 can be made of any suitable material (e.g., rubber, elastic, metal) that can anchor a well tool in a wellbore when in the deployed position by contacting a pipe or casing of the wellbore. The keys 107 can include any suitable shape for a desired well tool or operation (e.g., an anchor as shown in FIGS. 1A-1F, adjustable bullnose keys 407 as shown in FIG. 4). For example, in certain embodiments, the keys 107 can be cone-shaped, spherical-shaped, or slip shaped.

Figure 2A:
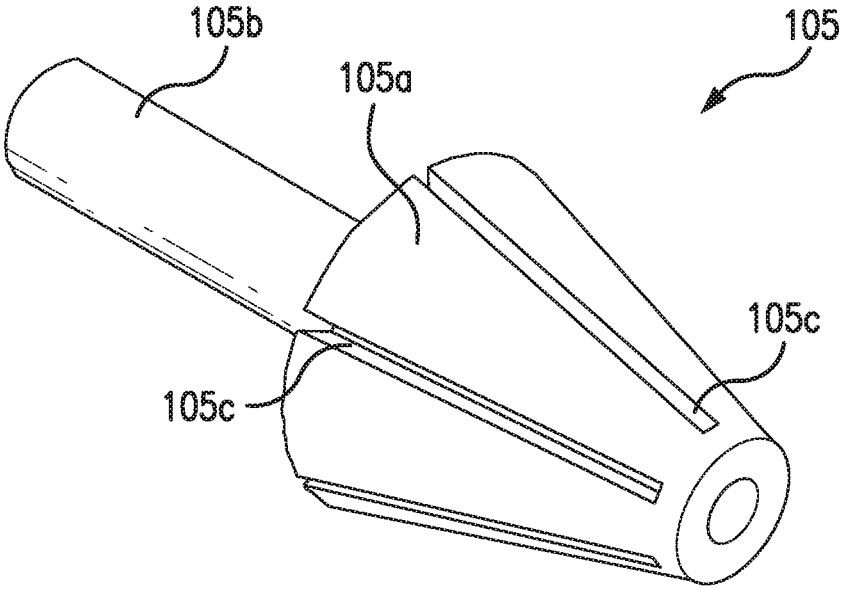
FIG. 2A is a perspective view of an embodiment of an actuator in accordance with this disclosure.
Figure 2B:
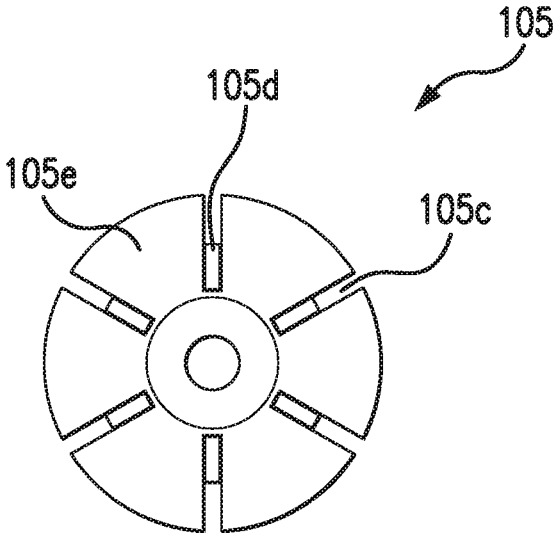
FIG. 2B is an upward plan view of the actuator of FIG. 2A.

Referring additionally to FIGS. 2A and 2B, the actuator 105 can include a frustoconical shape as shown, or any other suitable shape (e.g., with angled and/or curved surfaces relative to a longitudinal axis). As shown, the ramp portion 105*a* can include a plurality of slits 105*c* defined therein. While the actuator 105 is shown including an inner ramp portion 105*d* and an outer ramp portion 105*e*, it is contemplated that the actuator 105 can have only an outer ramp portion 105*e* and/or be hollow in the center thereof. The size and steepness of the ramp portion 105*a* can be selected to control how much axial movement of the actuator 105 affects a radial position of the keys 107. This can be used independently or together with threading of the worm gear to control precision of motion of the keys 107.

Figure 3A:
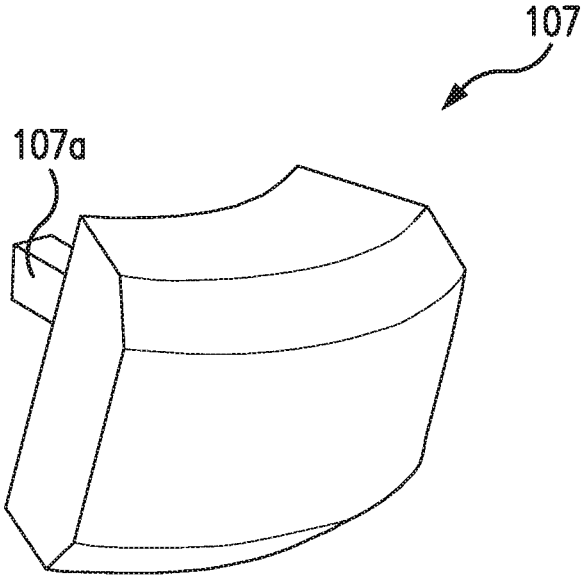
FIG. 3A is a perspective view of an embodiment of a key in accordance with this disclosure.
Figure 3B:
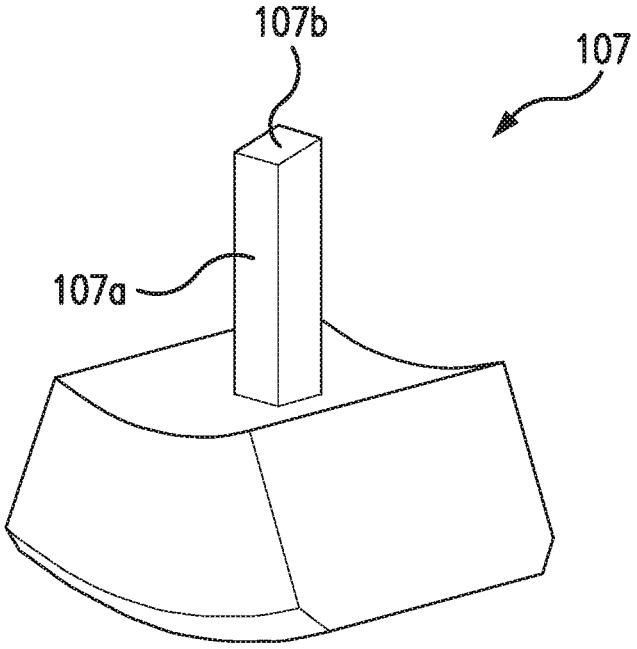
FIG. 3B is a perspective view of the key of FIG. 3A.

Referring additionally to FIGS. 3A and 3B, one or more of the keys 107 can include a post 107*a* and have a slight curvature, with the post 107*a* extending radially inward therefrom. The post 107*a* of each key 107 can extend into one of the plurality of slits 105*c* defined in the ramp portion 105. As shown, the actuator 105 is attached to the keys 107 via posts 107*a*, and the keys 107 are prevented from rotating by slits 105*c*. This can fix the actuator 105 rotationally such that the actuator 105 is prevented from rotating and is forced to advance axially when the threaded shaft 103 is rotated. However, in embodiments where the keys 107 are not mated with or otherwise suitably attached to the actuator 105, the actuator 105 can be fixed from rotating in any other suitable manner (e.g., by one or more ribs disposed on the inside of the tubular body 101 that fit into a slit 105*c*).

A back portion 107*b* of each post 107*a* can slidably contact the ramp portion 105*a*, e.g., at inner ramp portion 105*d*. In certain embodiments, the back portion 107*b* of each post 107*a* can include a shape that complements a slope of the ramp portion 105*a* to contact the ramp portion 105*a* in a flush manner. However, it is contemplated that one or more of the posts 107 can be sized to not contact the inner ramp portion 105*d*, and the keys 107 may directly contact the outer ramp portion 105*e*.

In certain embodiments, the keys 107 can be retracted in any suitable manner (e.g., retracted with a suitable hydraulic, mechanical, or electromechanical mechanism). For example, the posts 107*a* on the keys 107 can be held captive (but able to slide) in the slots 101*a*. For example, one or more flanges (not shown) can extend laterally from each post 107*a* at back portion 107*b* (e.g., to form a "T" with the post 107*a*), and the ramp portion 105 can define a corresponding flange slot 107 between the inner ramp portion 105*d* and the outer ramp portion 105*c*. This can allow the keys 107 to retract as the actuator 105 moves (e.g., by pulling on the one or more flanges as the ramp portion 105*a* moves axially upward) since the keys 107 are axially prevented from moving due to their placement within the key slots 101*a*. In certain embodiments, the keys 107 can be biased inwardly in any suitable manner (e.g., via a spring). Any other suitable configuration for retracting the keys 107 is contemplated herein.

In accordance with at least one aspect of this disclosure, a well tool can include an actuation device for well operations as described above. In certain embodiments, the well tool can be a whipstock anchor (e.g., using device 100 as shown in the embodiment in FIGS. 1A-1E). In certain embodiments, the well tool can be a bullnose assembly (e.g., using device 400 as shown in FIG. 4). It is contemplated that embodiments of the actuation device can be used with any suitable well tool or system.

As described above, as the threaded shaft 103 rotates, the actuator 105 travels in the downward direction (e.g., from FIG. 1B to FIG. 1E), which pushes the keys 107 outwardly until they contact a surface (e.g., a wellbore casing). When the threaded shaft 103 is rotated in the opposite direction, the actuator 105 moves back up and the keys 107 can be retracted to their original position (e.g., if biased into the housing or body 101). Using such a device 100, the position of the keys 107 can be controlled very accurately, as one full turn only moves the keys 107 a desired amount, and/or the keys 107 can be locked in any suitable position. This could be used to "tag" landing nipples or other features within the well to determine the depth of each feature. For example, the keys 107 (which can form a ring) could be extended for tagging the shallowest landing nipple in a well, and could then be contracted down hole to check for deeper landing nipples with smaller inner diameters.

Therefore, in certain embodiments, a variable-diameter ring (formed of a plurality of keys 107) can expand and contract while in the well to perform a variety of tasks downhole. This capability can be useful for drifting past certain obstacles in the well and then expanding to engage the profile of other components. Embodiments can be used in a variety of retrieval applications. For example, the ring could be sent downhole to tag the top of a tool that is to be retrieved, then adjusted to a smaller diameter to pass through the inner diameter of the tool, and then extended to engage in an internal shoulder along the inner diameter of the tool for retrieval. In certain embodiments, the keys 107 can include brushes to operate as a cleaning tool that can expand/retract to clean any bore size.

Embodiments of the disclosure can be used as a fishing tool to remove various items from the well. The keys 107 in such embodiments may be replaced with slips that could engage a surface of the tool to be removed. Certain embodiments can be attached to a bottom hole assembly (BHA) to act as a centralizer. For example, the outer diameter of the centralizer could be adjusted downhole to fit various bore diameters that the BHA would need to be centered within.

Aspects

In accordance with at least one aspect of this disclosure, an actuation device for well operations can include a tubular body including a plurality of key slots, a threaded shaft disposed within the tubular body that rotates relative to the tubular body and is fixed axially relative to the tubular body, an actuator disposed within the tubular member that moves axially relative to the tubular body, wherein the actuator includes a ramp portion and a threaded neck portion that engages with the threaded shaft such that when the threaded shaft rotates, the actuator moves axially relative to the tubular body, and a plurality of keys, each disposed in one of the plurality of key slots and in operative communication with the ramp portion such that as the actuator moves axially relative to the tubular body, each key is urged radially outwardly from the tubular body.

In accordance with any aspect as described herein or combinations thereof, the actuator can define a frustoconical shape or any other suitable shape.

In accordance with any aspect as described herein or combinations thereof, the ramp portion can include a plurality of slits defined therein.

In accordance with any aspect as described herein or combinations thereof, the keys can include a post extending radially inward therefrom.

In accordance with any aspect as described herein or combinations thereof, the post of each key can extend into one of the plurality of slits defined in the ramp portion.

In accordance with any aspect as described herein or combinations thereof, a back portion of each post can slidably contact the ramp portion.

In accordance with any aspect as described herein or combinations thereof, the back portion of each post can include a shape that complements a slope of the ramp portion to contact the ramp portion in a flush manner.

In accordance with any aspect as described herein or combinations thereof, the threaded neck of the actuator can include internal threads disposed within the threaded neck.

In accordance with any aspect as described herein or combinations thereof, the threaded shaft can include threads on an outer diameter thereof.

In accordance with at least one aspect of this disclosure, a well tool can include an actuation device for well operations as described above.

In accordance with any aspect as described herein or combinations thereof, the well tool can be a whipstock anchor.

In accordance with any aspect as described herein or combinations thereof, the well tool can be a bullnose assembly.

In accordance with any aspect as described herein or combinations thereof, embodiments of the actuation device can be used with any suitable well tool or system.

The methods and systems of the present disclosure, as described above and shown in the drawings, provide for actuation devices for wells with superior properties including controlled deployment of mechanical features, for example. While the apparatus and methods of the subject disclosure have been shown and described with reference to embodiments, those skilled in the art will readily appreciate that changes and/or modifications may be made thereto without departing from the spirit and scope of the subject disclosure.

What is claimed is:

1. An actuation device for well operations, comprising:

a tubular body including a plurality of key slots;

a threaded shaft positioned within the tubular body that rotates relative to the tubular body and is fixed axially relative to the tubular body;

an actuator disposed within the tubular body that is moveable axially relative to the tubular body, wherein the actuator includes a ramp portion and a threaded neck portion that engages with the threaded shaft such that when the threaded shaft rotates, the actuator moves axially relative to the tubular body; and a plurality of keys recessed within the tubular body, each key disposed in one of the plurality of key slots and in operative communication with the ramp portion such that as the actuator moves axially relative to the tubular body toward the plurality of keys, each key is urged radially outwardly from the tubular body;

wherein each key includes a post extending radially inward therefrom.

2. The actuation device of claim 1, wherein the actuator defines a frustoconical shape.

3. The actuation device of claim 1, wherein the ramp portion includes a plurality of slits defined therein.

4. The actuation device of claim 1, wherein the post of each key extends into one of the plurality of slits defined in the ramp portion.

5. The actuation device of claim 4, wherein a back portion of each post slidably contacts the ramp portion.

6. The actuation device of claim 5, wherein the back portion of each post includes a shape that complements a slope of the ramp portion to contact the ramp portion in a flush manner.

7. The actuation device of claim 1, wherein the threaded neck of the actuator includes internal threads disposed within the threaded neck.

8. The actuation device of claim 1, wherein each of the plurality of key slots is shaped to axially and circumferentially fix each key in the tubular body to urge said key radially outwardly from said tubular body as the actuator moves axially relative to the tubular body toward the plurality of keys.

9. A well tool, comprising:

an actuation device for well operations, comprising:

a tubular body including a plurality of key slots;

a threaded shaft positioned within the tubular body that rotates relative to the tubular body and is fixed axially relative to the tubular body;

an actuator disposed within the tubular body that is moveable axially relative to the tubular body, wherein the actuator includes a ramp portion and a threaded neck portion that engages with the threaded shaft such that when the threaded shaft rotates, the actuator moves axially relative to the tubular body; and a plurality of keys recessed within the tubular body, each key disposed in one of the plurality of key slots and in operative communication with the ramp portion such that as the actuator moves axially toward the tubular body, each key is urged radially outwardly from the tubular body;

wherein each key includes a post extending radially inward therefrom.

10. The well tool of claim 9, wherein the actuator defines a frustoconical shape.

11. The well tool of claim 9, wherein the ramp portion includes a plurality of slits defined herein.

12. The well tool of claim 9, wherein the post of each key extends into one of the plurality of slits defined in the ramp portion.

13. The well tool of claim 12, wherein a back portion of each post slidably contacts the ramp portion.

14. The well tool of claim 13, wherein the back portion of each post includes a shape that complements a slope of the ramp portion to contact the ramp portion in a flush manner.

15. The well tool of claim 9, wherein the threaded neck of the actuator includes internal threads disposed within the threaded neck.

16. The well tool of claim 9, wherein each of the plurality of key slots is shaped to axially and circumferentially fix each key in the tubular body to urge said key radially outwardly from said tubular body as the actuator moves axially relative to the tubular body toward the plurality of keys.

17. The well tool of claim 9, wherein the well tool is a whipstock anchor.

18. The well tool of claim 9, wherein the well tool is a bullnose assembly.

* * * * *